US009376914B2

(12) United States Patent
Vading

(10) Patent No.: US 9,376,914 B2
(45) Date of Patent: Jun. 28, 2016

(54) ROTARY MACHINE

(71) Applicant: TOCIRCLE INDUSTRIES AS, Oslo (NO)

(72) Inventor: Kjell Vading, Bodø (NO)

(73) Assignee: TOCIRCLE INDUSTRIES AS, Oslo (NO)

( * ) Notice: Subject to any disclaimer, the term of this patent is extended or adjusted under 35 U.S.C. 154(b) by 173 days.

(21) Appl. No.: 14/365,931

(22) PCT Filed: Dec. 18, 2012

(86) PCT No.: PCT/NO2012/050250
§ 371 (c)(1),
(2) Date: Jun. 16, 2014

(87) PCT Pub. No.: WO2013/095156
PCT Pub. Date: Jun. 27, 2013

(65) Prior Publication Data

US 2014/0356213 A1 Dec. 4, 2014

(30) Foreign Application Priority Data

Dec. 19, 2011 (NO) ..... 20111749

(51) Int. Cl.
*F01C 1/00* (2006.01)
*F01C 1/344* (2006.01)
(Continued)

(52) U.S. Cl.
CPC ..... *F01C 1/3446* (2013.01); *F01C 1/344* (2013.01); *F01C 19/00* (2013.01); *F01C 19/08* (2013.01); *F01C 21/0836* (2013.01)

(58) Field of Classification Search
CPC ..... F01C 1/3446; F01C 1/352; F01C 1/3441; F01C 1/04; F01C 19/00; F01C 21/0836; F04C 2/352; F04C 2/334; F04C 18/352
USPC ..... 418/241, 138
See application file for complete search history.

(56) References Cited

U.S. PATENT DOCUMENTS 1,006,896 A 10/1911 Augustine
3,537,432 A 11/1970 Jordaan
(Continued)

FOREIGN PATENT DOCUMENTS

DE 2616687 A1 11/1977
DE 2616687 A1 * 11/1977 ..... F01C 1/3446
(Continued)

OTHER PUBLICATIONS

International Search Report issued in PCT/NO2012/050250 dated Apr. 15, 2013.
(Continued)

*Primary Examiner* — Patrick Maines
(74) *Attorney, Agent, or Firm* — Winstead PC

(57) ABSTRACT

A rotary machine (1) in the form of an expander is shown. The Expander Induces a housing (5) having a cavity (9), inlet and outlet ducts (11, 12) communicating with the cavity (9), a rotor (2) having a rotor axis (A), a number of vanes (15*a*, 15*b*, 15*c*) movably received in respective grooves (18) in the rotor (2) and articulately connected about an axis (C) to one end of a control arm (14*a*, 14*b*, 14*c*) and in the other end rotatable supported in a fixed shaft (24) extending centrally through the cavity (9) in the housing (5), and at least one working chamber (9*a*) which is part of the cavity (9), The housing (5) includes an internally cylindrical intermediate part (5*c*), which part interact with the rotor (2) and the vanes (15*a*, 15*b*, 15*c*). The rotor (2) forms a reel configuration having respective radially extending flange portions (2*a'*, 2*b'*) which are rotatable together with the vanes, and against which the respective end surfaces of the vanes act.

20 Claims, 8 Drawing Sheets

Figure 1:
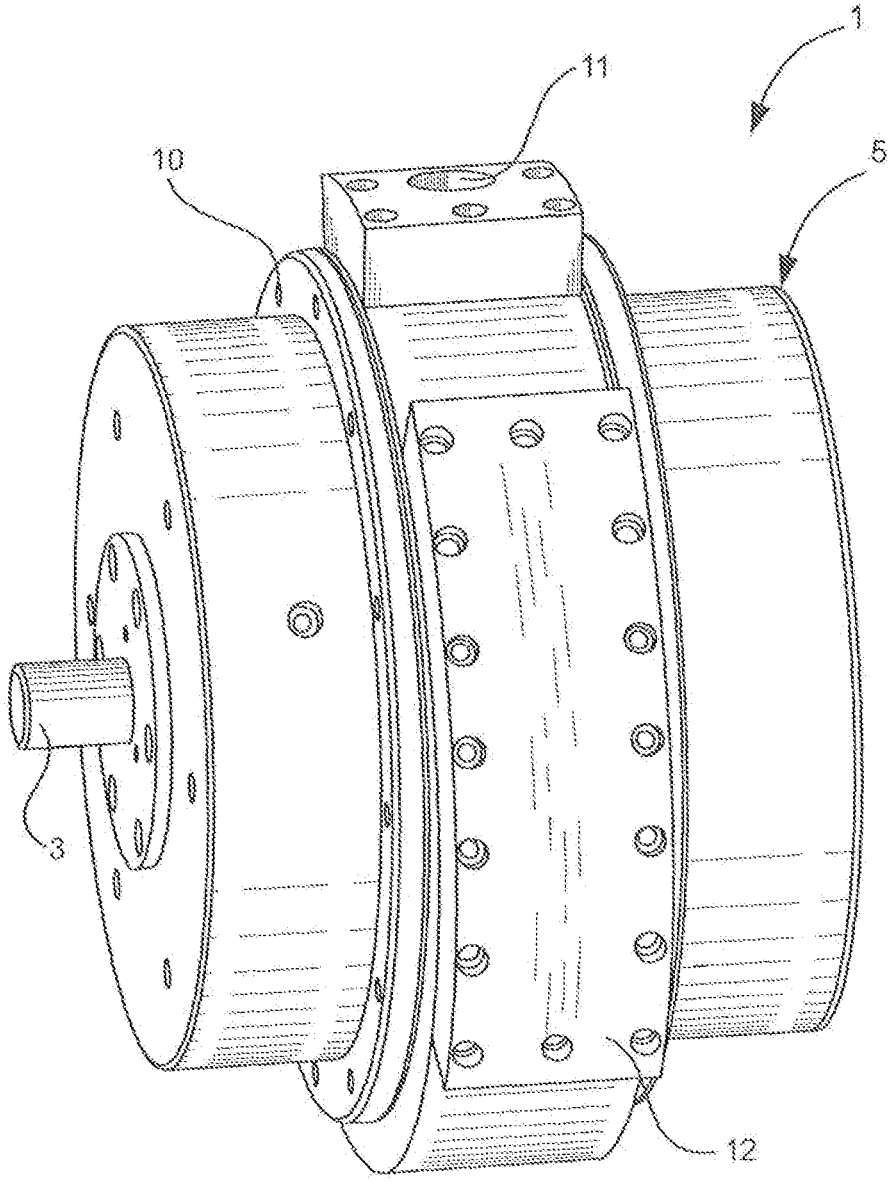

(51) Int. Cl.

| | |
|---|---|
| ***F01C 19/08*** | (2006.01) |
| ***F01C 21/08*** | (2006.01) |
| ***F01C 19/00*** | (2006.01) |

(56) References Cited

U.S. PATENT DOCUMENTS

| | | | | | |
|---|---|---|---|---|---|
| 3,626,265 | A | | 12/1971 | Kraakman | |
| 4,019,840 | A | * | 4/1977 | Christy | F01C 1/352 418/137 |
| 4,061,450 | A | * | 12/1977 | Christy | F04C 2/352 418/253 |
| 4,385,873 | A | | 5/1983 | Richter | |
| 4,403,581 | A | * | 9/1983 | Rogachevsky | F01C 1/352 123/239 |
| 4,451,218 | A | | 5/1984 | Rembold | |
| 4,451,219 | A | * | 5/1984 | Kurherr | F01C 1/3446 418/138 |
| 4,767,295 | A | | 8/1988 | Biek | |
| 5,135,372 | A | | 8/1992 | Pipalov | |
| 5,489,199 | A | * | 2/1996 | Palmer | F01C 1/352 418/137 |
| 5,634,783 | A | * | 6/1997 | Beal | F01C 21/0836 418/264 |
| 6,273,694 | B1 | * | 8/2001 | Vading | F01C 1/352 418/13 |
| 2002/0076346 | A1 | | 6/2002 | Tomoiu | |
| 2006/0222544 | A1 | * | 10/2006 | Frolik | F01C 1/3442 418/54 |
| 2014/0377113 | A1 | * | 12/2014 | Flenche | F04C 28/14 418/185 |

FOREIGN PATENT DOCUMENTS

| | | | | | |
|---|---|---|---|---|---|
| DE | 3011399 | A1 | | 10/1981 | |
| DE | 3011399 | A1 | * | 10/1981 | F01C 1/3446 |
| GB | 114584 | A | | 4/1918 | |
| GB | 1003607 | A | | 9/1965 | |
| GB | 2071767 | A | | 9/1981 | |
| NO | 307668 | B1 | | 5/2000 | |
| NO | 307668 | B1 | | 5/2000 | |
| WO | WO-9943926 | A1 | | 9/1999 | |
| WO | WO 9943926 | A1 | * | 9/1999 | F01C 1/352 |

OTHER PUBLICATIONS

International Preliminary Report on Patentability issued in PCT/NO2012/050250 dated Apr. 14, 2014.

Written Opinion of the International Search Authority issued in PCT/NO2012/050250 dated Apr. 12, 2013.

* cited by examiner

ROTARY MACHINE

CROSS-REFERENCE

This application is the National Phase entry of International Application No. PCT/NO2012/050250, filed Dec. 18, 2012, which claims priority to Norwegian Patent Application No. 20111749, filed Dec. 19, 2011, both of which are incorporated herein by reference in their entireties.

The present invention relates to a rotary machine in the form of an expander, including a housing having a cavity, inlet and outlet ducts arranged in the housing and communicating with the cavity, a rotor received and supported in the housing and having a rotor axis, one or more vanes movably received in respective grooves in the rotor and where each vane is articulately connected about an axis to one end of a control arm which in the other end is rotatable supported in a shaft having a central axis coincident with the axis extending centrally through the cavity in the housing, which axis is parallel with and spaced apart a distance from the rotor axis, each vane tip describes a cylinder surface sector having its center of curvature in the axis through the joint that connects a vane with a control arm, at least one working chamber which is part of the cavity and is defined between the internal peripheral surface of the housing, the peripheral surface of the rotor and the side surface of at least one vane, where the rotor itself constitute the unit for power output.

The herein described and illustrated rotary machine is especially designed as an expander to be driven by steam.

The rotary machine can also be a thermo dynamical working machine which, after certain modifications, can be used both as compressor, pump, vacuum pump, heat exchanger and combustion engine. The rotary machine can be assembled of equal units and in series such that the machine principle is used both for the compressor unit and the combustion engine unit in a supercharged engine. Already at this stage, it is to be noted that the rotary machine is without any crankshaft and that the machine is supplied or takes out its power directly to/from the rotor.

The present rotary machine is a further development of the machine described in NO 307 668 (WO 99/43926), but still have many similar features and is thus incorporated as a reference.

Known combustion engines of the rotary type are embodied as rotating piston engines (Wankel). Here the rotating piston, which is in the form of a rotor having curved triangular shape, rotates in an annular cylinder chamber. Such combustion engines have, in addition to a complicated configuration, the disadvantage that the rotor has considerable sealing problems against the cylinder wall. In addition, these combustion engines have high fuel consumption.

From DE-3011399 a combustion engine having an engine housing with a working chamber that receives a continuously rotatable rotor, in addition to inlet and outlet for combustion gasses, is known. The rotor is substantially cylindrical and is rotating in an elliptical configured cavity which includes diametrically opposing combustion chambers defined by the rotor surface and the internal surface of the housing forming the cavity. The rotor is designed with radially Is extending sliding grooves which receive and guide wing pistons able to slide radially in and out in the sliding grooves. The wings are articulated joined via a piston rod to a crank which in turn is part of a journalled crankshaft. When the rotor rotates, the wing pistons will move radially in and out within the sliding grooves due to the fixed journaling to said crank. In this way the first wing set will act within one part of the cavity, i.e. the first combustion chamber, while the second wing set will act in the diametrically opposed chamber.

U.S. Pat. No. 4,061,450 shows a rotary pump of the wing type having a stationary housing and a cavity receiving a rotor. The rotor has slit groves in which the respective wings move, but in such a way that the wing tips moves toward and away from the internal peripheral surface of the housing for each rotation of the rotor.

U.S. Pat. No. 4,451,219 shows a rotary steam engine having two chambers and omit valves. This engine also has two sets of rotor blades having three blades in each set. Each set of rotor blades rotates around its own eccentric point on a stationary common crankshaft within an elliptic motor housing. A rotor of the drum type is centrally mounted within the motor housing and forms two diametrically opposed radially extending working chambers. The two sets of rotor blades move substantially radially in and out in sliding grooves in the rotor similar to the above described machine. Also here, the wings in their central end are supported in an eccentrically located shaft sub that is fixed. The wings, however, are not articulated, but are in their opposite end tiltable supported in a bearing arranged peripheral in the rotor.

Pumps and compressors of the vane type are also known. U.S. Pat. No. 4,451,218 is related to a vane pump having rigid vanes and a rotor which is eccentrically supported in the pump housing. The rotor has slits through which the vanes radially pass and are guided by. At each side of the sliding openings seals are arranged.

U.S. Pat. No. 4,385,873 shows a rotary machine of the vane type that can be used is as a motor, compressor or pump. This also has an eccentrically mounted rotor through which a number of rigid vanes radially pass.

Further examples of the prior art are shown in U.S. Pat. No. 3,537,432, U.S. Pat. No. 4,757,295 and U.S. Pat. No. 5,135,372.

Various objects with the present invention, though somewhat different regarding use and usage, is to provide a rotary machine having high efficiency, the ability to pump multi phase fluids, low fuel consumption and low emissions of polluting materials, like carbon monoxide, nitrous gases and non combusted hydrocarbons.

Moreover, one object with the present invention is to provide a rotary machine of compact construction, i.e. small engine volume and small total volume relative to effect provided.

According to the present invention a rotary machine of the introductory said kind is provided, which is distinguished in that the housing is assembled of an internally cylindrical intermediate part interacting with the rotor and the vanes, one end cover at each end of the internally cylindrical intermediate part, and that the rotor forms a reel configuration having respective radially extending flange portions which are rotatable together with the vanes, and against which the respective side surfaces of the vanes act.

In a preferable embodiment the rotor is assembled by two main parts, which parts together form the reel structure configuration. The partition surface between the two main parts will then typically extend in a radial direction.

In another embodiment the reel structure configuration can be manufactured in one single piece and then the housing will he assembled by two substantially C-formed housing parts, which parts together form the intermediate housing. This variant will have axially extending partition surfaces. Thus it will be possible to mount the two housing halves over the reel structure configuration when made in one single piece.

In a preferable embodiment the radially extending flange portions have on their circumferential surface a fine clearance relative to the internal circumferential surface of the respective end covers.

Preferably, the radially extending flange portions on their radially extending surfaces have a fine clearance relative to the internal end surface of the respective end covers.

Further, the radially extending flange portions on their radially extending surfaces can have a fine clearance relative to external, opposite radially extending surfaces of the intermediate housing.

Having such surfaces as mentioned that continuously alter direction, the fine clearances between the surfaces will provide a form of touch free labyrinth sealing.

However, it is to be understood that at least one of said fine clearances between said surfaces can have installed one or another form of mechanical seal, One example will be a seat of the type "piston ring" having a split, or of the type metallic piston ring having hooked ends that hook to each other. This type is often used as shaft seals in automatic transmissions.

Preferably the number of vanes can be three or more.

In one suitable embodiment, as here illustrated, the number of vanes is six.

In one embodiment the vane tips can include sealing means,

Preferably, the vane groves can include slide bearings that interact with each vane.

Suitably, the fixed shaft in its free end can be supported and stabilized in the rotor by means of an eccentric adapter.

Figure 2:
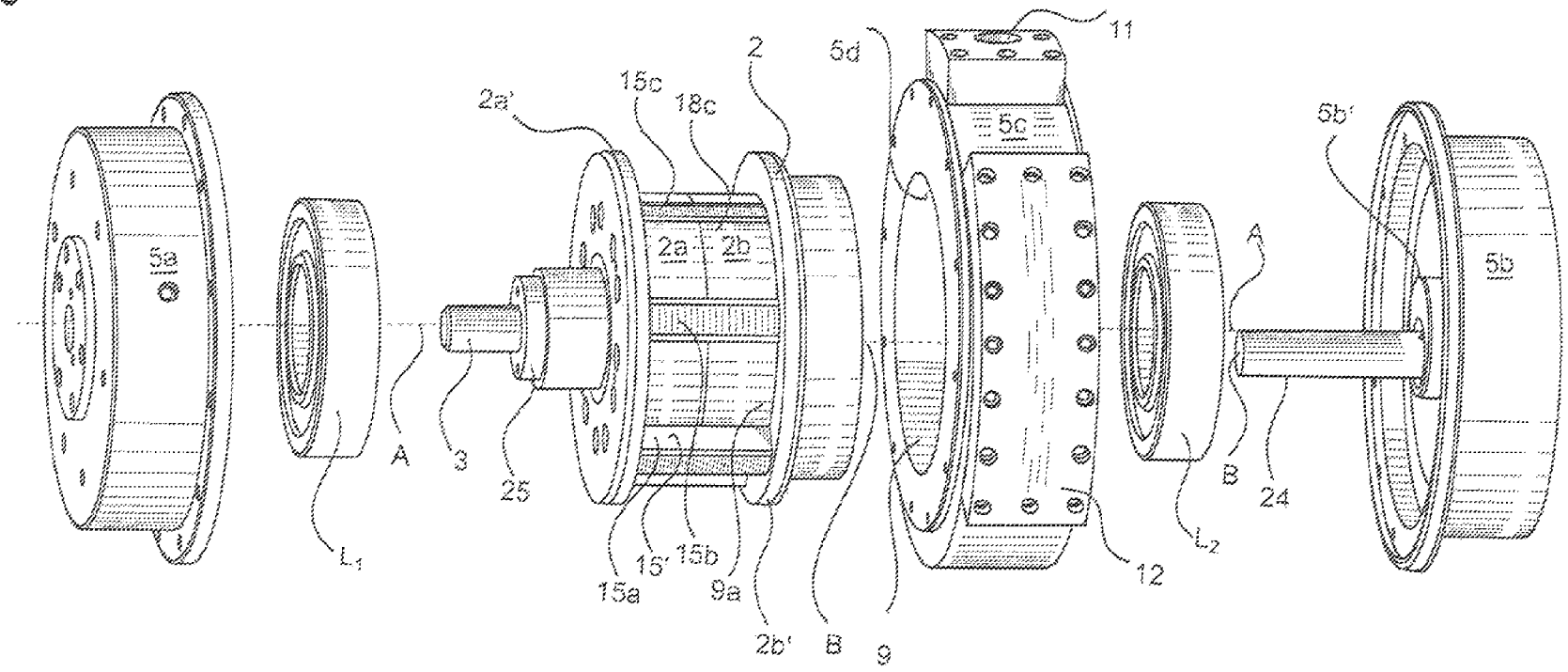
Figure 3:
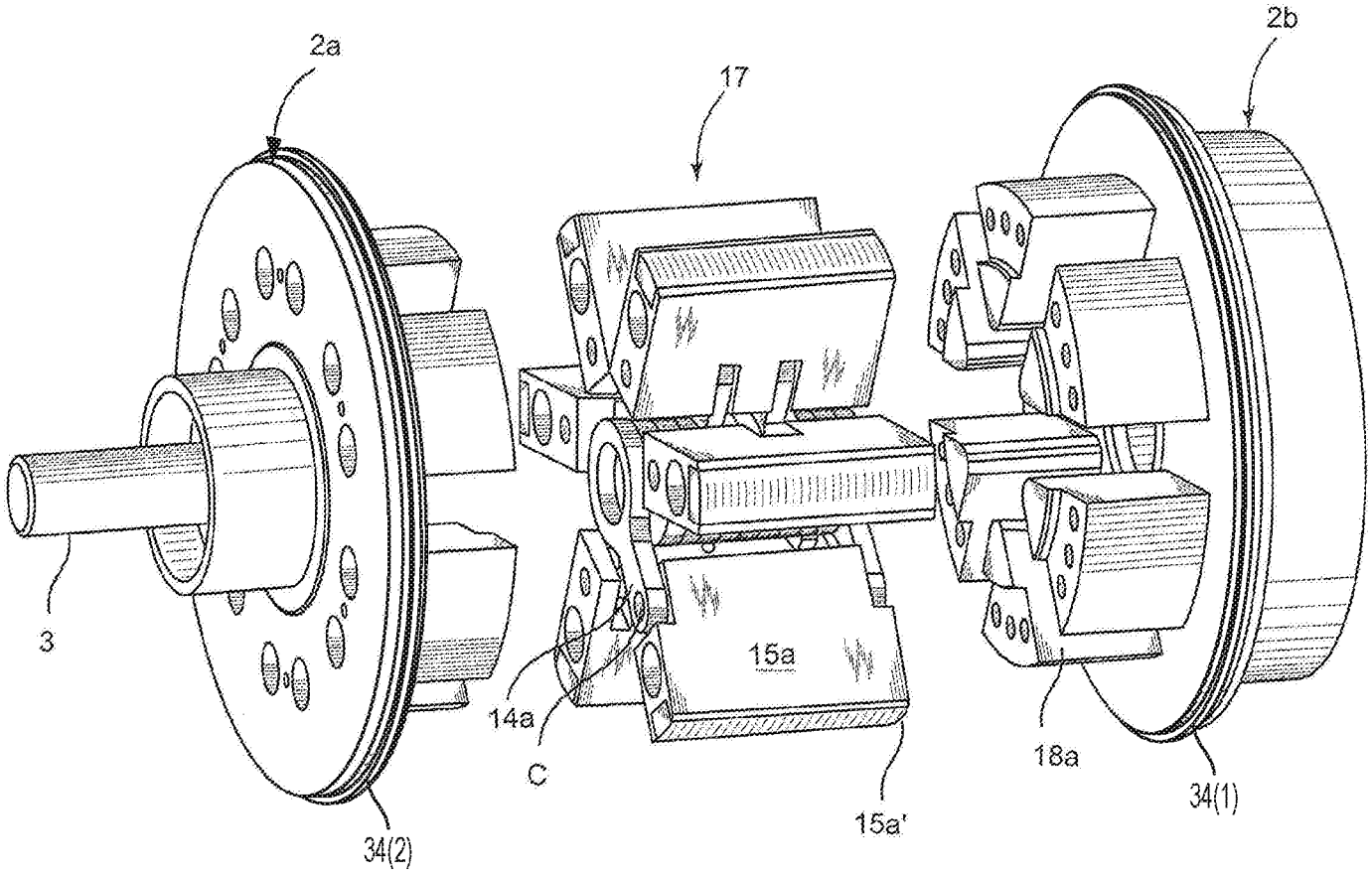
Figure 4:
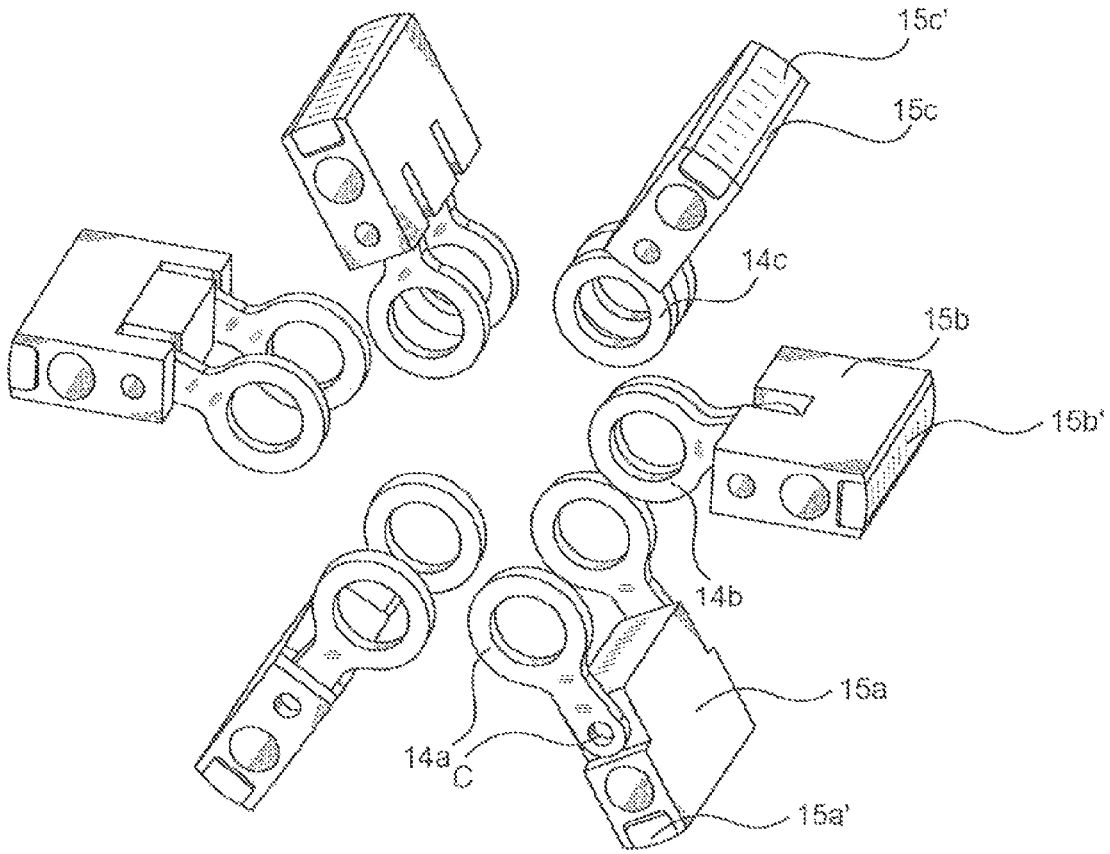
Figure 5:
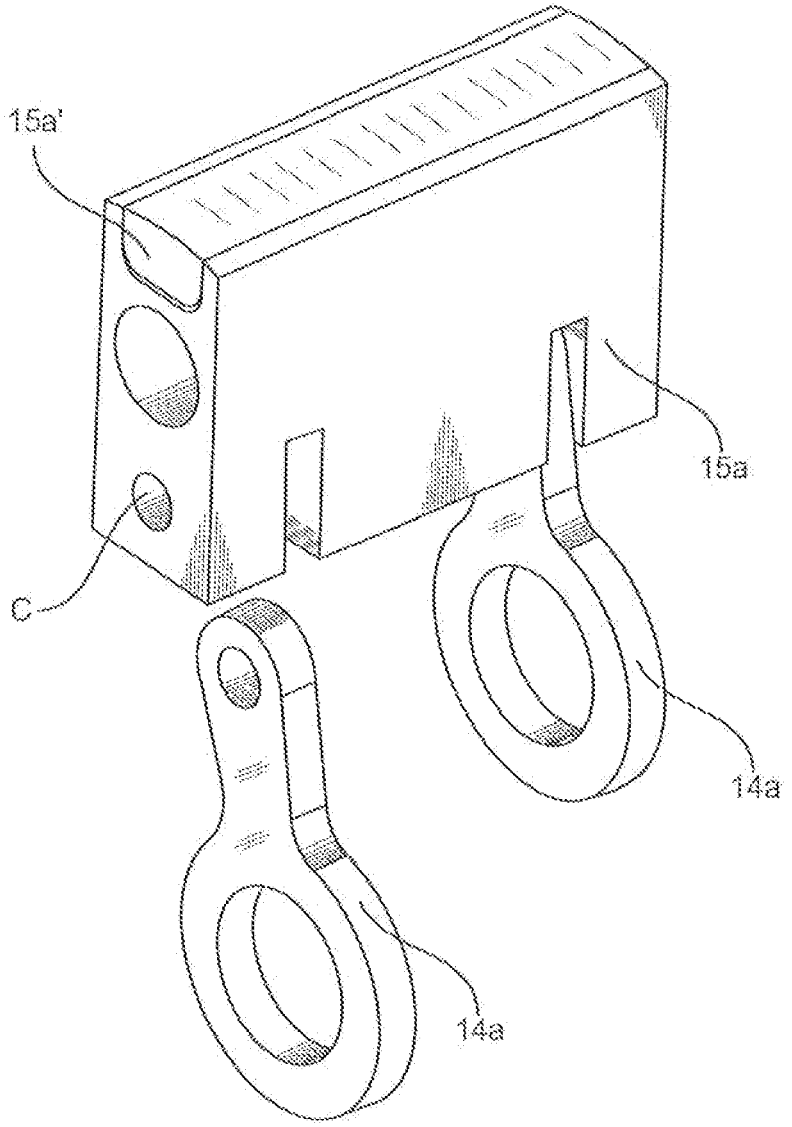
Figure 6:
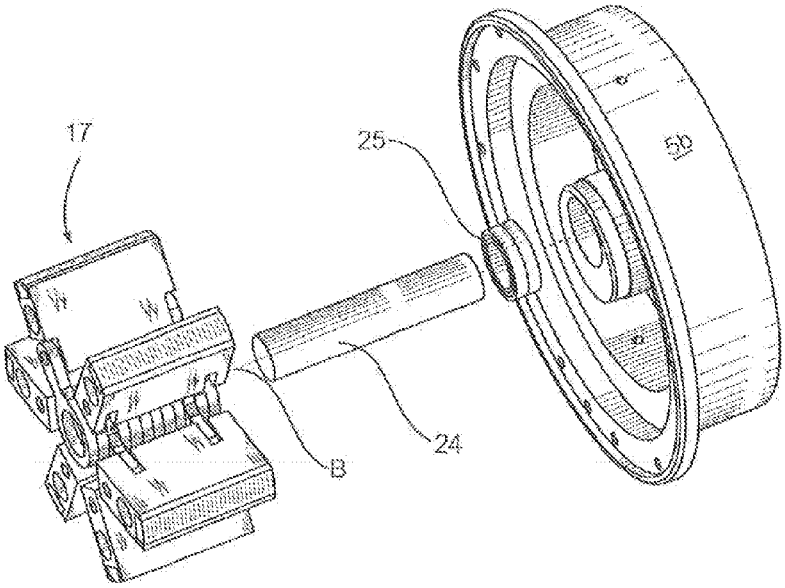
Figure 7:
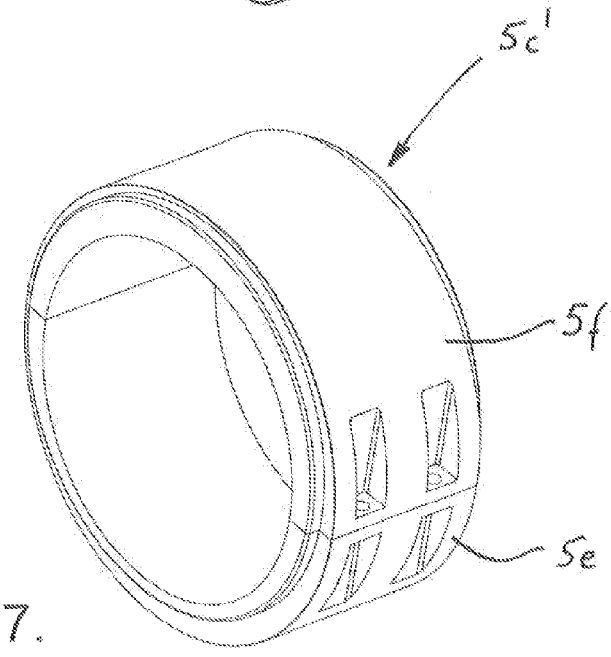
Figure 8A:
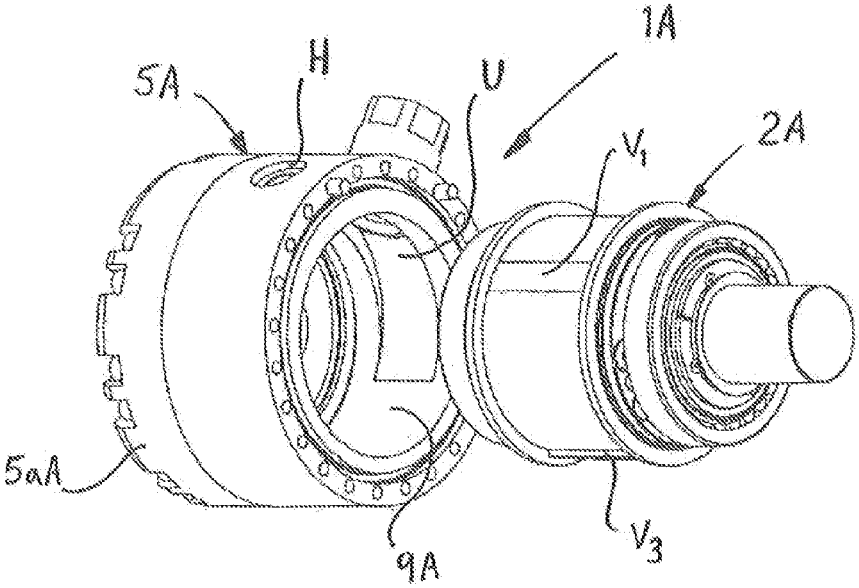
Figure 8B:
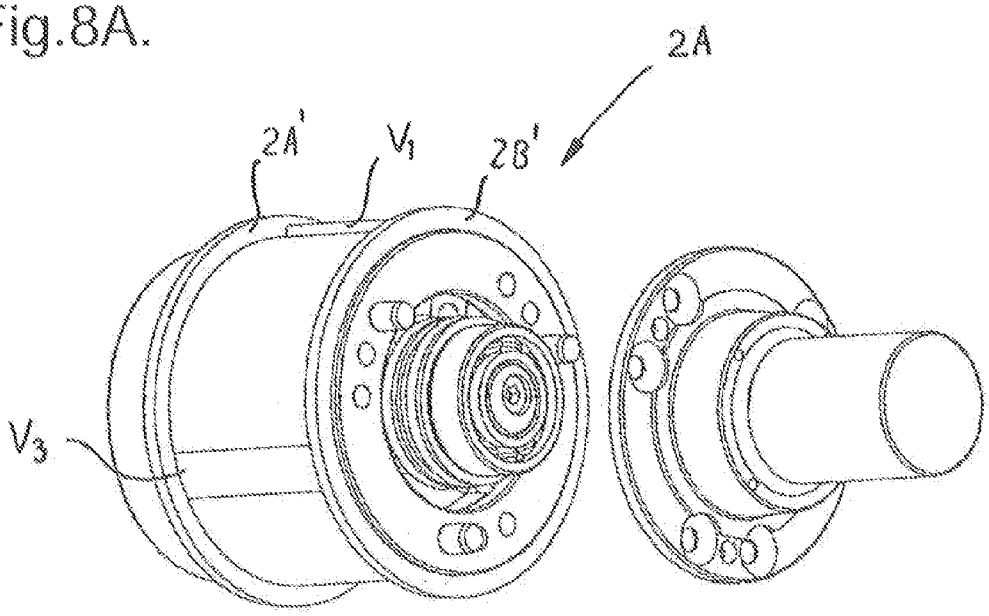
Figure 9A:
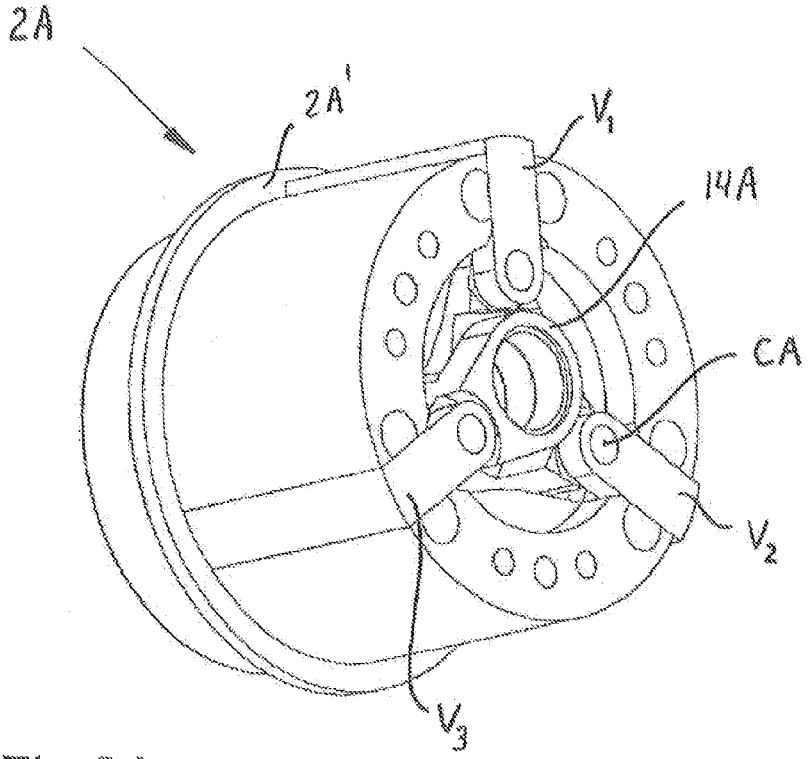
Figure 9B:
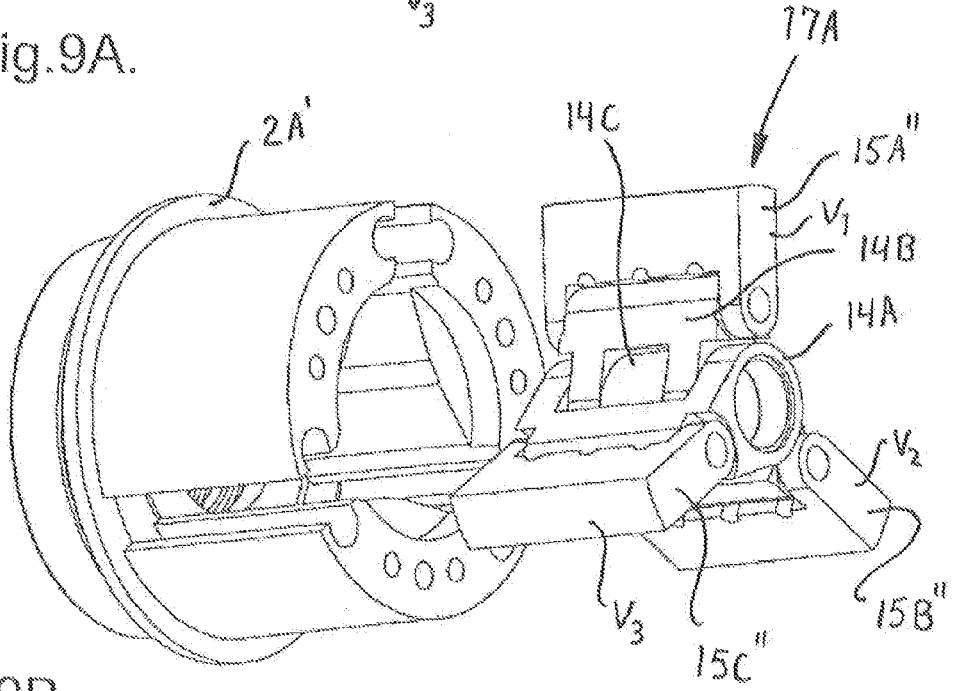

One exemplified embodiment of the rotary machine according to the invention, will now be described in closer detail with reference to the appended drawings where:

FIG. 1 shows in perspective view the completely assembled rotary machine as a very compact unit, FIG. 2 shows in perspective view the machine according to FIG. 1 with the parts separated from each other, FIG. 3 shows in perspective view the rotor alone and with the parts separated from each other, FIG. 4 shows in perspective view the vanes separated from the rotor, FIG. 5 shows in perspective view one single vane including its control arms, FIG. 6 shows the vane unit and its journalled shaft and one end cover, FIG. 7 shows a variant where the intermediate housing is divided in two C-formed parts,

8A shows in perspective view a rotary machine having three vanes as a second embodiment, FIG. 8B shows in perspective view the rotary unit of the second embodiment, FIG. 9A shows in perspective view the rotary unit of the second embodiment without the one end cover, and FIG. 9B shows in perspective view the rotary unit of the second embodiment where the vane unit is pulled out.

FIG. 1 shows an embodiment of a rotary machine according to the invention in the form of an expander 1 ready assembled and in the way it will look like during use. The expander 1 includes a housing 5 that circumscribe a rotor supported within the housing 5. The housing 5 includes an inlet 11 for vapor and an outlet 12 for expanded vapor. An axle or shaft 3 forms power take off and can be connected to other machinery for usage of the energy of the rotary machine.

In order to understand the construction of the rotary machine reference is given to FIG. 2 showing de individual parts and how they are assembled to form the expander 1. Reference is also given to NO 307668 (WO 99143926) to ease the understanding of the mode of operation of the machine.

Again, it is to be noted that this is an embodiment of the machine which is designed as an expander. As mentioned the construction, with various minor modifications and adaptions, can also be used to construct a combustion engine, compressor, heat exchanger or pump as examples. It is further to be noted that the machine is constructed and manufactured with such precision that use of seals shall be at a minimum. The construction material can be different steel grades, but also plastics and Teflon may be well suitable for some applications.

The expander 1 includes an intermediate housing 5*c* and first and second end covers 5*a*, 5*b* which together enclose a rotor 2. The intermediate housing 5*c* has an internal cylindrical surface 5*d* that circumscribe the rotor 2, which rotor 2 in turn is eccentrically located relative to the internal cylindrical surface 5*d*. The shaft 3 representing the power take off from the rotor 2 is shown on FIGS. 1 and 2. Note that the machine is omit crankshaft and the power is taken out directly from the rotor 2 through the shaft 3. The rotor 2 rotates about a rotary axis A that is different from the longitudinal axis, marked B in FIG. 2, of the intermediate housing 5C.

The figures illustrate how the intermediate housing 5*c* is assembled together with the end covers 5*a*, 5*b* by means of a series bolts 10 around the circumference thereof. The internal cylindrical peripheral surface 5*d* of the intermediate housing 5*c* circumscribes a cavity 9. The peripheral surface 5*d* has respective ducts recessed therein that define inlet 11 and outlet 12.

For the further physical structure of the expander 1, and in particular the rotor 2, reference is now made to FIG. 3, which should be view together with FIG. 2. FIG. 3 shows the rotor housing made up by two rotor housing halves 2*a*, 2*b* and the vane unit 17 of the rotor 2. Each vane unit 17 is in turn made up by six rotor vanes 15*a*, 15*b*, 15*c* etc, see FIG. 5. Each rotor vane 15*a*, 15*b*, 15*c* etc slideably co-acts with respective radially extending slits 18*a* formed in the rotor housing 2*a*, 2*b*. The side surfaces of the slits 18*a* support and carry slideably the respective rotor vanes 15*a*, 15*b*, 15*c* etc when the expander is in operation. Under "full throttle", the force acting in the circumferential direction against the respective rotor vanes 15*a*, 15*b*, 15*c* etc, will be substantial and contributes to a tilting or pitching moment in the rotor vanes 15*a*, 15*b*, 15*c* etc about a line along the exit opening of the slit 18*a*.

The vane unit 17, as clearly shown on FIGS. 4 and 5, with the parts spaced apart, also show a number of control arms 14*a*, 14*b*, 14*c* etc where two and two are supposed to carry respective rotor vanes 15*a*, 15*b*, 15*c* etc. Each pair of control arms 14*a*, 14*b*, 14*c* etc and the rotor vane 15*a*, 15*b*, 15*c* etc have the same function and they are articulately connected to each other via an axle having an axis C. The control arms 14*a*, 14*b*, 14*c* etc are assembled such that their larger holes are aligned for later assembly to a common shaft 24. When these parts are mounted together they form the vane unit 17 of the rotor 2 operating on the shaft 24 as clearly illustrated in FIG. 6.

Each vane tip 15*a*', 15*b*', 15*c* etc describes a cylinder surface sector having its centre of curvature in the axis C through the joint connecting the vanes 15*a*, 15*b*, 15*c* etc to the control arms 14*a*, 14*b*, 14*c* etc. The idea behind this is that the vane tip, along an imaginary line extending in parallel with the rotor axis A, is at any time to "touch" the internal surface 5*d* of the intermediate housing 5*c*, but still not make direct contact with the surface 5*d*. This imaginary line will "move" back and forth on the vane tip during rotation of the rotor 2 and will at any time describe a cylinder surface which is approximately equal to the internal surface 5*d* of the housing 5*c* with difference only in the clearance present between the vane tip and the internal surface 5*d* of the housing. The clearance between the vane tip and the internal surface 5*d* shall be as small as practically possible to make it.

Each vane tip 15*a*', 15*b*', 15*c'* etc can also be formed of different material than the vane itself, such as shown on the figures. Each vane tip 15*a*', 15*b*', 15*c'* etc can be in the form of an insert. They can also in some applications be in contact with the surface 5*d*, and even be spring loaded against the surface 5*d*.

Reference is again made to FIG. 2 which shows that the first end cover 5*a* also carries a first bearing $L_1$ which in turn supports the rotor 2 in one end, i.e., via the axle shaft 3 along the axis A and centrally within the end cover 5*a*. Correspondingly the second end cover 5*b* is shown carrying a second bearing $L_2$ that supports the rotor 2 in the opposite end and centrally within the end cover 5*b*, still along the axis A. It is to be noted that the rotor 2 is not supported in the axle shaft 24, but in the central bearing boss 5*b*' via the bearing $L_2$. The bearing boss 5*b*' is located concentric internally of the end cover 5*b*.

It is further to be understood that the rotor needs to be mounted in the intermediate housing 5*c* in such a way that the respective housing halves 2*a*, 2*b* are displaced towards each other from each side of the intermediate housing 5*c*. The rotor 2, having the shape of a reel, will have its side or end walls extending beyond the side surfaces of the intermediate housing 5*c* when the parts are mounted to each other. Thus, only the vane tips 15*a*', 15*b*', 15*c*' etc are located inside the internal surface 5*d* of the intermediate housing 5*c*.

The rotor housing 5 is thus made up by an internally cylindrical intermediate part 5*c* co-operating with the rotor 2 and the vanes 15*a*, 15*b*, 15*c* etc and respective end covers 5*a*, 5*b* at each end of the internally cylindrical intermediate part 5*c*. The rotor 2 is in turn made up by two main parts 2*a*, 2*b* which together form a reel structure configuration having respective radially extending flange portions 2*a*', 2*b*' which are rotatable together with the vanes and against which the respective side surfaces of the vanes act.

It is further to be understood that in a practical embodiment the radially extending flange portions 2*a*', 2*b*' will on their peripheral surface have fine clearance relative to an internal circumferential surface in the respective end covers 5*a*, 5*b*. Further, the radially extending or pointing flange portions 2*a*', 2*b*' will on their radially pointing surfaces have fine clearance relative to an internal end surface in respective end covers 5*a*, 5*b*. Also the radially pointing flange portions 2*a*', 2*b*' have on their radially pointing surfaces fine clearance relative to external opposite radially pointing surfaces on the intermediate housing 5*c*. Thus it is to be understood that the mentioned fine clearances between the mentioned surfaces provides kind of a contact free labyrinth sealing. It is still possible that in some circumstances, or situations, it will be appropriate to install a suitable physical sealing organ between one or more of the surfaces having said fine clearance. In order to enhance the labyrinth sealing effect, one or more grooves can in addition be formed in the peripheral surfaces of the flange portions 2*a*', 2*b*'. Alternatively one or more grooves can be formed internally in the covers 5*a*, 5*b* into which the flange portions 2*a*', 2*b*' extend and to which said peripheral surface interface.

However, it is to be understood that at least one of said fine clearances between said surfaces in some embodiments can have installed one or another form of mechanical sealing means. One example can be a seal of the type "piston ring" having a split, or of the type metallic piston ring having hooked ends to be hooked to each other. This type of seal is frequently used as shaft seals in automatic transmissions. "The piston rings" can be spanned against the housing and may form one or more further labyrinths with corresponding grooves in the side or end walls of the reel. Piston rings 34(1) and 34(2) are illustrated in FIG. 3.

Velocity, temperature, purity requirements and pressure will be factors to determine which type of material that is suitable, but the reel walls are as mentioned already a labyrinth in itself. As already known, the clearances are made as small as possible and are adapted to the substance to be put through.

FIG. 6 shows the axle shaft 24 to be introduced into the vane unit 17 and to journal the respective control arms 14*a*, 14*b* and 14*c* etc. The shaft 24 has the central axis B which is different from the axis A. The figure shows the shaft 24 and a bearing 25 ready for installation on the end of the shaft 24. The bearing 25 is located eccentric in the bearing boss 5*b*'. The rotor housing covers 5*a*, 5*b* are centric relative to the axis A, but eccentric relative to longitudinal axis B of the intermediate housing 5*c* and the axle shaft 24. At the same time the axle shaft 24 supports each vane 15*a*, 15*b*, 15*c* etc centrically relative to the longitudinal axis B, but eccentrically relative to the longitudinal axis A through the rotor housing.

This means that the vanes 15*a*, 15*b* and 15*c* etc, when considering the vanes in isolation or separately, actually do not move radially neither in nor out, but perform a small nodding or tilting movement about the axis C when the rotor 2 rotates. Since the halves 2*a*, 2*b* of the rotor housing is eccentric located relative to the vanes 15*a*, 15*b*, 15*c* etc, i.e. has a different rotary axis than the vanes, the vanes 15*a*, 15*b*, 15*c* etc will apparently move in and out within the grooves 18*a*, With that we obtain, during the rotation of the rotor 2, one chamber behind a vane that expands until it reaches a maximum volume until it again decreases. Further, a very significant result is obtained in that no radially acting mass forces arises that would create imbalances.

As one will understand, the axle shaft 24 is at stand still and is fixedly secured. The duty thereof is to control the vanes 15*a*, 15*b*, 15*c* etc via the control arms 14*a*, 14*b*, 14*c* etc in their relative movement relative to the grooves 18*a*. Still, it is possible to contemplate a variant where the axle shaft 24 is rotatable or is not "fixed".

Each vane 15*a*, 15*b*, 15*c* etc is as mentioned articulately connected to one end of a control arm 14*a*, 14*b*, 14*c* etc, which in its other end is rotatable journalled in the stationary axle shaft 24. The control arms 14*a*, 14*b*, 14*c* etc do not transfer any working forces, but provides for that each vane 15*a*, 15*b*, 15*c* etc is controlled by forced motion in the guide grooves or slits 18*a* in the rotor housing 2*a*, 2*b* such that the vane tips 15*a*', 15*b*', 15*c*' etc at any time during the rotation of the rotor 2 are tangent (touching without contact) to the internal surface 5*d* of the intermediate housing 5*c*.

The cavity 9 can be subdivided in an expansion chamber 9*a* and an outlet chamber 9*b*, which chambers are displaced during rotation and are determined by the position of the vanes relative to the inlet 11 and outlet 12.

The operation of the rotary machine will now be described and with reference to the drawings. As previously mentioned, the embodiment example shows an expander. A throttling medium such as vapor is supplied to the inlet. The vapor hits a vane tip and experiences expansion and thus is pushing on the vane Even if the expansion chamber 9*a* gradually is cut off by a new vane tip emerging, the action surface toward the preceding vane will be larger and thus apply force in same direction. Immediately after the expansion chamber has reached its maximum, the outlet chamber 9*b* opens up and let the expanded vapor pass out the outlet 12.

The period of expansion starts when a vane 15*a*, 15*b*, 15*c* etc passes the inlet duct 11 to the chamber 9*a* and lasts until the vane opens up for the outlet chamber and the outlet duct 12. As one will understand, that side of the vanes 15*a*, 15*b*, 15*c* etc facing opposite to the rotation direction R constitutes the pressure side of the expander. Technically considered, the expansion period includes both the filling phase and the expansion phase of a chamber. For the chamber defined by the rotor, housing, vane 15*a* (in front in rotation) and 15*b* (last in rotation), the filling phase will start when 15*a* passes the beginning of the inlet and end when 15*b* passes the end of the inlet. The expansion phase begins when the filling phase terminates and ends when 15*a* passes the beginning of the outlet.

It is further to be understood that the vane tips perform a "rolling motion" against the internal cylinder surface 5*d* of the intermediate housing 5*c* during its revolution with the rotor 2. By one haft revolution of the rotor 2, each vane tip has performed one rolling motion between the outer edges of the vane tip arc. Thus the vane tips are roiling one time forth and back during one revolution of the rotor 2.

Reference is now made to FIG. 7 showing schematically a rotary machine housing where the intermediate housing 5*c*' is made up by two substantially C-formed housing parts 5*e*, 5*f*. The housing parts 5*e*, 5*f* form together a housing having axially extending partition surfaces. It is bolted together in top and in bottom and can with preference be machined subsequent to such assembly such that a finishing fine machining turning and adaption are made before final assembly over a reel structure configuration, which reel then can be made in one single piece, though not necessarily. The inlet and outlet ducts are not drawn.

FIG. 8A-9B show a second embodiment where the rotor has three vanes only and the circumscribing housing is somewhat simplified. The entire construction of the rotary machine will not be described again, only those parts that deviate from the first embodiment.

FIG. 8A Shows the rotary machine 1A, or the expander, in perspective view and where the rotary unit 2A is shown pulled out of the housing 5A. It is also shown an outlet duct U internally of the housing 5A, and an inlet hole H with an option to make connection. In FIG. 8B the rotor unit 2A is shown in perspective view.

FIG. 9A shows in perspective view the rotary unit 2A in the second embodiment without the first end wall, and where the three vanes $V_1$-$V_3$ are shown, in FIG. 9B the vane assembly 17A is shown pulled out from the rotary unit 2A.

The rotary machine 1A includes as mentioned the housing 5A having an internal cylindrical cavity 9A and respective end covers, where one end cover 5*a*A is shown, net and outlet channels or ducts H, U are provided in the housing 5A and are in communication with the cavity 9A. A rotor 2A is received and supported in the housing 5A and have one or more vanes $V_1$, $V_2$, $V_3$ that are moveably received in respective grooves in the rotor 2A. Each vane $V_2$, $V_3$ are articulately connected about one axis CA to one end of a control arm 14A, 14B, 14C and in the other end is pivotable supported in an axle shaft having a central axis coincident with the axis extending centrally through the cavity 9A of the housing 5A. Each vane tip describes a cylinder surface sector having its centre of curvature in the axis through the joint connecting one vane $V_1$, $V_2$, $V_3$ with a control arm 14A, 14B, 14C. The rotor 2A is manufactured as a reel structure configuration including respective radially pointing flange portions 2A', 2B'. The flange portions 2A', 2B' are co-rotating with the vanes $V_1$, $V_2$, $V_3$ and the respective end surfaces 15A", 15B", 15C" of the vanes are acting against said flange portions 2A', 2B'. The radially pointing flange portions 2A', 2B' extend beyond the diameter of the cavity within the cylindrical intermediate part of the housing 5A for the creation of a labyrinth seal with respective end covers and the, internal cylindrical intermediate part.

The invention claimed is:

1. A rotary machine in the form of an expander, comprising a housing having an internally cylindrical cavity and respective end covers, inlet and outlet ducts arranged in the housing and communicating with the cavity, a rotor received and supported in the housing and having a rotor axis (A), at least one vane movably received in respective grooves in the rotor, each vane being articulately connected about an axis (C) to one end of a control arm and in the other end being rotatable supported in a shaft having a central axis (B) coincident with the axis (B) extending centrally through the cavity in the housing wherein the axis (B) is parallel with and spaced apart a distance (d) from the rotor axis, (A), each vane tip describes a cylinder surface sector having its center of curvature in the axis through the joint that connects a vane with a control arm, at least one working chamber which is part of the cavity and is defined between an internal peripheral surface of the housing, a peripheral surface of the rotor and a side surface of the at least one vane, wherein the rotor itself comprises a unit for power output, wherein the rotor is designed as a reel structure configuration having respective radially extending flange portions, the flange portions are co-rotatable with the at least one vane, and against which the respective end surfaces of the at least one vanes act, and that said radially extending flange portions extend beyond the diameter of the cavity of a cylindrical intermediate section of the housing to form a labyrinth seal with respective end covers at each end of the internal cylindrical intermediate portion of the housing.

2. The rotary machine according to claim 1, wherein the rotor comprises two main parts, wherein the two main parts together form said reel structure configuration.

3. The rotary machine according to claim 1, wherein the housing comprises two substantially C-formed housing parts, wherein said two substantially C-formed housing parts together form a housing having axially extending partition surfaces and are adapted to be mountable over said reel structure configuration made in one piece.

4. The rotary machine according to claim 1, wherein the radially extending flange portions on radially extending surfaces have a fine clearance relative to an internal circumferential surface of the respective end covers.

5. The rotary machine according to claim 1, wherein the radially extending flange portions on radially extending surfaces have a fine clearance relative to an internal end surface of the respective end covers.

6. The rotary machine according to claim 1, wherein the radially extending flange portions on radially extending surfaces have a fine clearance relative to external, opposite radially extending surfaces of the cylindrical intermediate section of the housing.

7. The rotary machine according to claim 4, wherein said fine clearance between said surfaces provides a form of touch free labyrinth seal.

8. The rotary machine according to claim 4, wherein said fine clearance between said surfaces has a mechanical seal.

9. The rotary machine according to claim 1, comprising more than three vanes.

10. The rotary machine according to claim 1, comprising more than six vanes.

11. The rotary machine according to claim 1, wherein vane tips are configured to function as seals.

12. The rotary machine according to claim 1, wherein vane groves comprise slide bearings that interact with each vane.

13. The rotary machine according to claim 1, wherein a free end of the shaft is supported and stabilized in the rotor by means of an eccentric adapter.

14. The rotary machine according to claim 5, wherein said fine clearance between said surfaces provides a form of touch free labyrinth seal.

15. The rotary machine according to claim 6, wherein said fine clearance between said surfaces provides a form of touch free labyrinth seal.

16. The rotary machine according to claim 5, wherein said fine clearance between said surfaces has a mechanical seal.

17. The rotary machine according to claim 6, wherein said fine clearance between said surfaces has a mechanical seal.

18. The rotary machine according to claim 8, wherein the mechanical seal is a piston ring.

19. The rotary machine according to claim 16, wherein the mechanical seal is a piston ring.

20. The rotary machine according to claim 17, wherein the mechanical seal is a piston ring.

* * * * *